US005387919A

United States Patent [19]

Lam et al.

[11] Patent Number: 5,387,919

[45] Date of Patent: Feb. 7, 1995

[54] DIPOLE ANTENNA HAVING CO-AXIAL RADIATORS AND FEED

[75] Inventors: Tommy H. Lam, Endicott; Matthew J. Milicic, Jr., Newark Valley; Don M. Pritchett, Apalachin, all of N.Y.

[73] Assignee: International Business Machines Corporation, Armonk, N.Y.

[21] Appl. No.: 68,728

[22] Filed: May 26, 1993

[51] Int. Cl.[6] ..... H01Q 9/16

[52] U.S. Cl. ..... 343/821; 343/822; 343/795

[58] Field of Search ..... 343/821, 700 MS, 795, 343/793, 820, 822, 827; H01Q 9/16, 11/10, 9/28

[56] References Cited

U.S. PATENT DOCUMENTS

| | | | |
|---|---|---|---|
| 3,611,389 | 10/1971 | Coors | 343/821 |
| 3,845,490 | 10/1974 | Manwarren et al. | 343/821 |
| 3,947,850 | 3/1976 | Kaloi | 343/795 |
| 4,084,162 | 4/1978 | Dubost et al. | 343/700 |
| 4,410,893 | 10/1983 | Griffee | 343/821 |
| 4,814,783 | 3/1989 | Shelton et al. | 343/795 |
| 4,825,220 | 4/1989 | Edward et al. | 343/795 |
| 5,021,799 | 6/1991 | Kobus et al. | 343/795 |
| 5,229,782 | 7/1993 | Hemmie et al. | 343/821 |

OTHER PUBLICATIONS

IEEE Symposium on Antennas & Propagation, 1984, Digest vol. 1, pp. 70–73, D. K. Reynolds et al. (no month available).

Antenna Engineering Handbook, Second Ed., R. C. Johnson Editor, McGraw-Hill, pp. 27–12 thru 27–15 (no date available).

The Handbook of Antenna Design, vol. 1 & 2, Editors A. W. Rudge et al., Peter Peregrinus Ltd. Publishers, p. 1444 (no date available).

Antenna, Kraus, McGraw Hill, pp. 1–9 (no date available).

VHF and UHF Antennas, pp. 1420–1428 (no date available).

VHF/UHF Communication Antenna Equipment, Chu Associates, Inc., (no date available).

*Primary Examiner*—Donald Hajec
*Assistant Examiner*—Hoanganh Le
*Attorney, Agent, or Firm*—Arthur J. Samodovitz

[57] ABSTRACT

A dipole antenna comprises first and second antenna radiators and first and second balanced transmission-line conductors which are electrically connected to the first and second antenna radiators, respectively. An inner conductor and a shield of a coaxial cable are electrically connected to the first and second balanced conductors, respectively to transmit a drive signal to the first and second antenna radiators. A balun is electrically connected to an intersection of the coaxial cable and the first and second balanced conductors. The first and second antenna radiators and the first and second balanced conductors are supported substantially along a common axis such that the first and second balanced conductors separate the first and second antenna radiators from the balun and coaxial cable. The balun can also be supported generally along the same axis.

29 Claims, 4 Drawing Sheets

DIPOLE ANTENNA HAVING CO-AXIAL RADIATORS AND FEED

BACKGROUND OF THE INVENTION

The invention relates to the design of a dipole antenna.

Dipole antennas have many commercial and military applications such as cellular telephones and other mobile communications and data links. An ideal dipole antenna has broad bandwidth, high efficiency, an unobstructed radiation path and minimal spurious radiation, and for mobile applications, can withstand mechanical vibrations.

Many types of dipole antennas, such as those illustrated in FIGS. 1–3, are known in the art. The antenna of FIG. 1 comprises quarter wavelength dipole radiators 10 and 12, balanced transmission-line conductors 14 and 16, a balun 18, a coaxial cable 20 and a drive signal source 22. The balanced conductors 14 and 16 are formed on opposite sides of a dielectric support sheet (not shown) to match the impedance of the coaxial cable and cancel unwanted radiations from the equal and opposite currents flowing through the balanced conductors. The balun 18 comprises a one quarter wavelength strip conductor which is electrically connected to the end of the inner conductor of the coaxial cable 20, extends parallel to the coaxial cable 20 and electrically connects to the shield of the coaxial cable 20 one quarter wavelength from the end of the coaxial cable 20. The quarter wavelength of the shield also serves as part of the balun. The principle of operation of a balun is well known in the art; a balun reduces standing wave ratio, assists in impedance matching and prevents high frequency currents from flowing onto the shield of the coaxial cable from the radiators via the balanced conductors. Without a balun, such currents would cause unwanted radiation from the shield. The coaxial cable 20 transmits the drive signal from the drive signal source 22 to the radiators 10 and 12 via the balanced conductors 14 and 16. While the overall design minimizes unwanted radiation, the lateral position of the balanced conductors 14 and 16, balun 18 and coaxial cable 20 relative to the radiators 10 and 12 interferes with one direction of lateral radiation of the radiators. Also, the cantilevered support of the radiators is undesirable from a mechanical standpoint.

The antenna of FIG. 2 is a basic coaxial dipole design (and was disclosed in U.S. Pat. No. 2,184,729). A quarter wavelength radiator 30 is connected to an inner conductor 32 of a coaxial cable 34. An upper end of outer conductor 36 of the coaxial cable is connected to a concentric metal sleeve 38 which serves as the other radiator. The metal sleeve radiator is also one quarter wavelength and therefore, acts as a choke and presents a moderately high impedance between its lower end and the outer conductor 36 of the coaxial cable. This minimizes unwanted RF current flow in the outer conductor 36 of the coaxial cable. However, the bandwidth is limited because of the impedance nature of the choke formed by outer conductor 36 and the sleeve 38. A variation of this design uses a one-half wavelength radiator corresponding to feature 30 of FIG. 2 (as disclosed in U.S. Pat. No. 4,352,109). This configuration requires an inconvenient impedance transformation to the asymmetrical dipole feed location.

The antenna of FIG. 3 is similar to that of FIG. 2 and comprises a radiator 40, a metal sleeve radiator 41 and a coaxial cable 42. However unlike the antenna of FIG. 2, the antenna of FIG. 3 also includes a discrete choke 44 between the metal sleeve radiator (which can alternately be the outer conductor of a triaxial cable) and a discrete capacitor 46 between the two outer conductors (which can be metal braids). While such a design increases the impedance at the center frequency, the bandwidth is limited because of the additional discrete reactive components. Also, the choke is undesirable because it requires extra fabrication steps and skillful tuning.

A general object of the present invention is to provide a dipole antenna for which the feed arrangement does not interfere with the radiation pattern.

Another general object of the present invention is to provide a dipole antenna of the foregoing type which has minimal unwanted radiation.

Another general object of the present invention is to provide a dipole antenna of the foregoing type which has sufficient bandwidth for many applications.

Another general object of the present invention is to provide a dipole antenna of the foregoing type with good mechanical support.

Another general object of the present invention is to provide a dipole antenna of the foregoing types which can be fabricated economically.

SUMMARY OF THE INVENTION

The invention resides in a dipole antenna comprising a first antenna radiator providing one pole of the dipole antenna and a second antenna radiator providing another pole of the dipole antenna. First and second balanced transmission-line conductors of a first balanced transmission line are electrically connected to the first and second antenna radiators, respectively. Third and fourth conductors of a second transmission line are electrically connected to the first and second balanced conductors, respectively so the second transmission line can transmit a signal to the first and second antenna radiators via the first and second balanced conductors. A balun is electrically connected to an intersection of the first and second transmission lines. The first and second antenna radiators and the first and second balanced conductors are supported substantially along a common axis such that the first and second balanced conductors separate the first and second antenna radiators from the balun and second transmission line. According to one feature of the invention, the balun is also supported generally along the same axis.

DETAILED DESCRIPTION OF THE PREFERRED EMBODIMENTS

Figure 1:
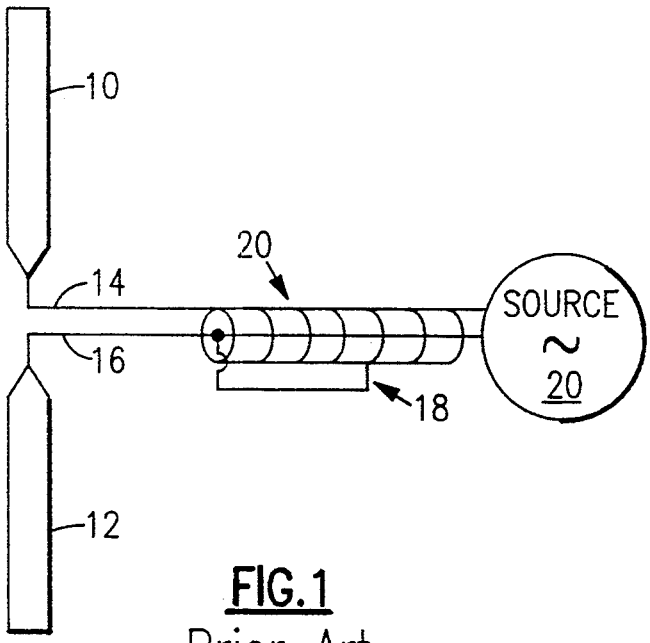
FIG.1 Prior Art
FIGS. 1–3 illustrate three different dipole antennas according to the prior art.
Figure 2:
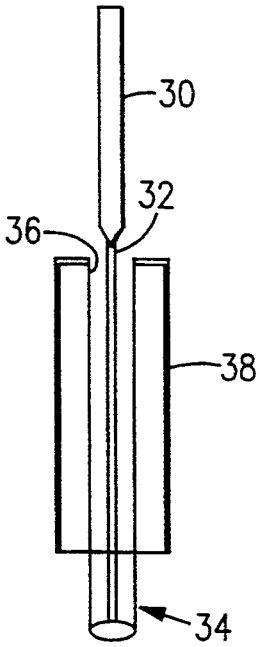
FIG.2 Prior Art
Figure 3:
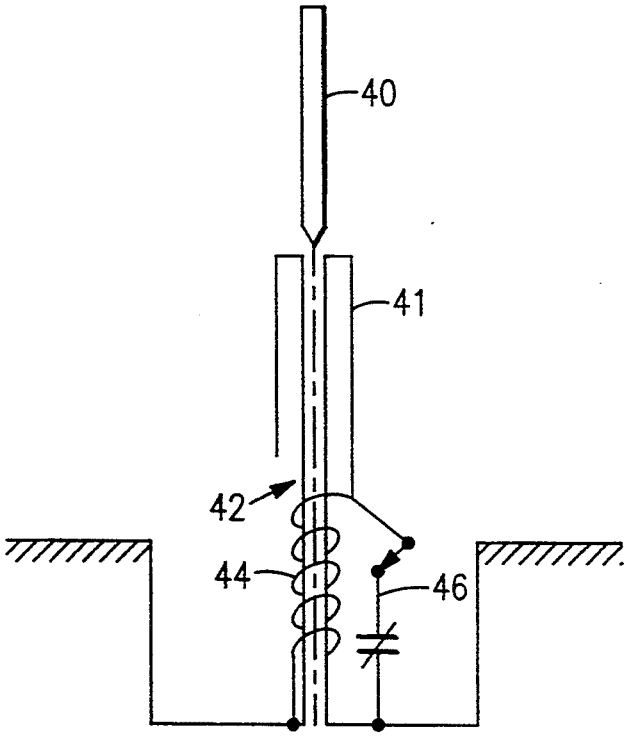
FIG.3 Prior Art

Referring now to the figures in detail wherein like reference numerals indicate like elements throughout the several views, FIGS. 1–3 illustrate three different dipole antennas according to the prior art and have been described above in the "Background of the Invention" section.

Figure 4:
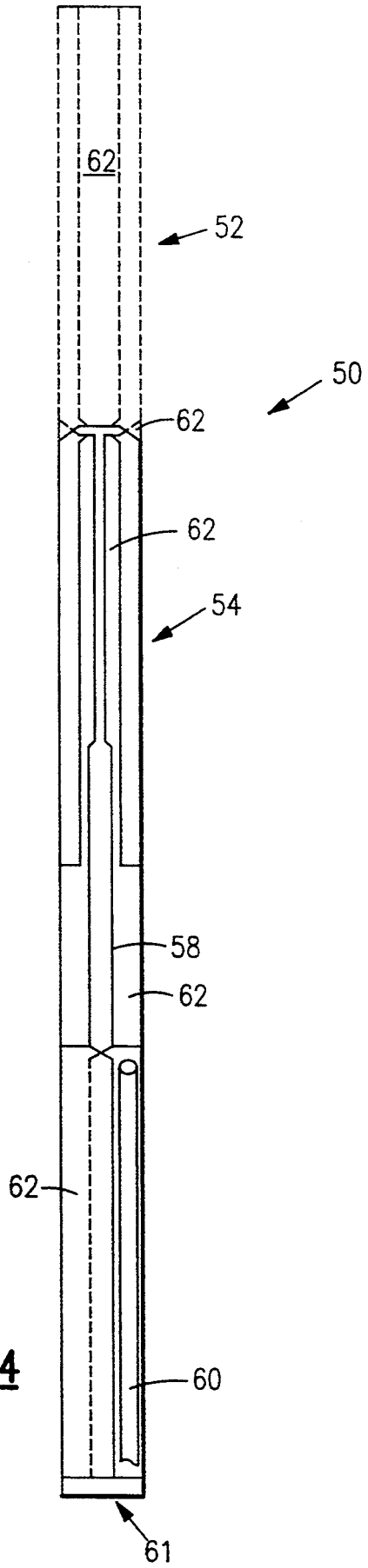
FIG. 4 illustrates a dipole antenna according to the present invention.

FIG. 4 illustrates a dipole antenna generally designated 50 according to one embodiment of the present invention. Antenna 50 comprises "U-shaped" metallic radiators 52 and 54, respective metallic balanced transmission-line conductors 56 (FIG. 6) and 58, a coaxial cable 60 and a balun 61. Each of the radiators is mounted or printed on one side of a dielectric sheet 62 and is one quarter wavelength in length. By way of example, a gap between the arms of each radiator is ¼", the thickness of the dielectric sheet is 32/1000", the sheet is made of fiberglass reinforced Teflon (a Trademark of E. I. dupont De Nemours) resin (generically polytetrafluoroethylene) of the type commonly used in printed circuit boards, the width of the overlapping conductors of the radiators is 30/1000" and the impedance of the radiators is 100 ohms. The width of the nonoverlapping conductors of the radiators is 100/1000" but can be increased to increase the bandwidth. In the illustrated embodiment, the balanced conductors 56 and 58 are metal strips which are mounted or printed on opposite sides of dielectric substrate 62 so they are balanced and cancel one-another's unwanted radiation. The balanced conductors 56 and 58 also terminate/match the impedance of the coaxial cable (for example 50 ohms) and match the impedance of the radiators. To this end, each of the balanced conductors has a lower section which is 100/1000" in width to yield 50 ohm impedance and an upper section which is 80/1000" in width to yield a 70 ohm quarter-wavelength transformation section. The balanced conductors 56 and 58 also separate the lower radiator 54 from the balun and the coaxial cable to reduce unwanted capacitive coupling and thereby enhance the bandwidth.

Figure 5:
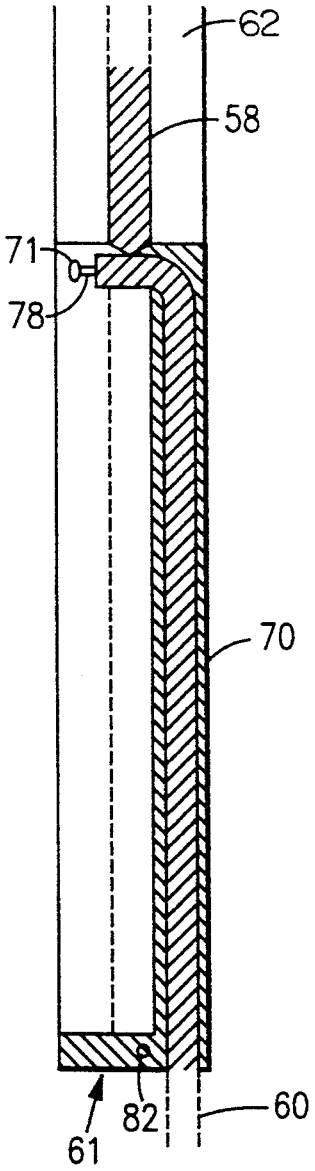
FIG. 5 illustrates in greater detail a lower portion of the dipole antenna of FIG. 4 from one side.
Figure 6:
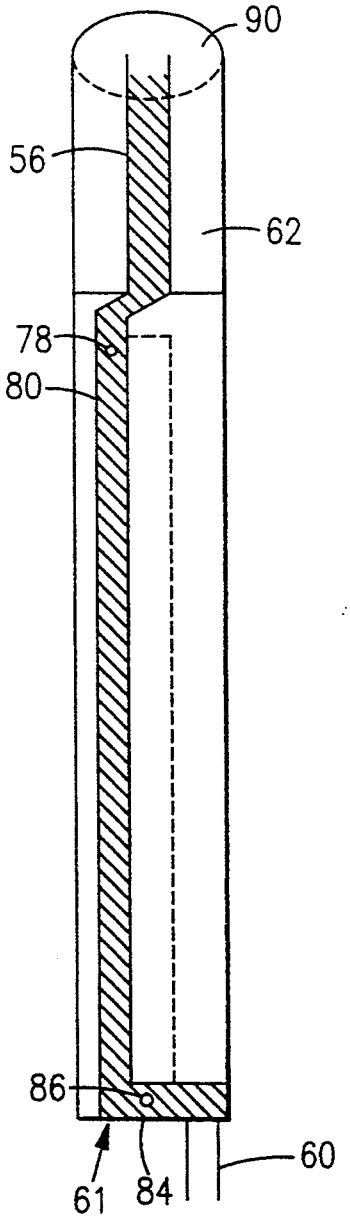
FIG. 6 illustrates in greater detail the lower portion of the dipole antenna of FIG. 4 from the other side.

As illustrated in FIGS. 4 and 5, the outer shield of the coaxial cable 60 is soldered to a strip conductor 70 along the entire length of the strip conductor 70. Strip conductor 70 is mounted or printed on dielectric substrate 62 and is contiguous with balanced conductor 58. As illustrated in FIGS. 5 and 6, an inner conductor 78 of coaxial cable 60 passes through a hole 71 in dielectric substrate 62 (avoiding contact with strip conductor 70) and is soldered to another strip conductor 80 which is mounted or printed on the opposite side of dielectric substrate 62. Strip conductor 80 is contiguous with balanced conductor 56. Thus, the voltage transmitted by coaxial cable 60 is supplied across radiators 52 and 54.

Balun 61 comprises strip conductor 70, strip conductor 80 and lateral strip conductors 82 and 84. Strip conductors 70 and 80 are each one quarter wavelength. Lateral strip conductors 82 and 84 are mounted or printed on opposite sides of substrate 62 and interconnected with each other by a pin 86 which passes through the substrate 62 and is soldered to both balun strip conductors 82 and 84. The balun 61 reduces the standing wave ratio, assists in impedance matching and prevents unwanted radiation from the shield of coaxial cable 60. Because the balun, coaxial cable 60 and balanced conductors 56 and 58 are located along the axis of the radiators, they are out of the way of and do not interfere with the radiation pattern from the radiators 52 and 54. Also, the axial design provides better mechanical support for the radiators compared to the cantilevered prior art design of FIG. 1. The antenna are preferable encased in a sealed dielectric "radome" tube 90 to prevent environmental damage to the antenna and provide mechanical support. Because of the axial design of the antenna, this casing has a simple tubular design.

Figure 7:
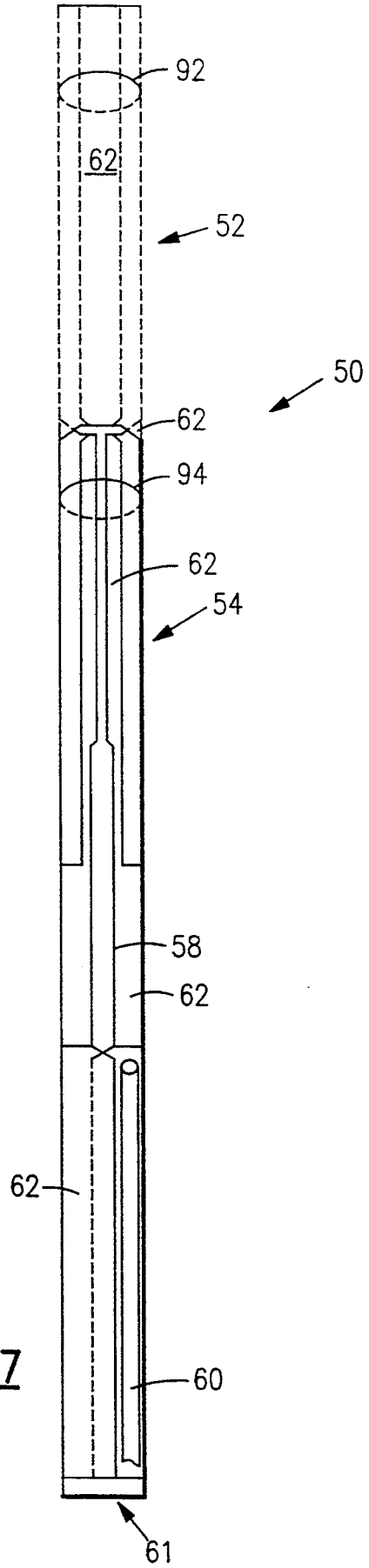
FIG. 7 illustrates an alternate embodiment of the dipole antenna of FIG. 4.

FIG. 7 illustrates an alternate embodiment of the present invention in which a metal sleeve or tube 92 is soldered to and surrounds radiator 52 and a metal sleeve or tube 94 is soldered to and surrounds radiator 54. The purpose of the metal sleeves is to increase bandwidth and efficiency of radiation and is considered superior to the design of FIG. 1. By way of example, the diameter of each of the sleeves is ½", the length of each of the sleeves is one quarter wavelength.

Figure 8:
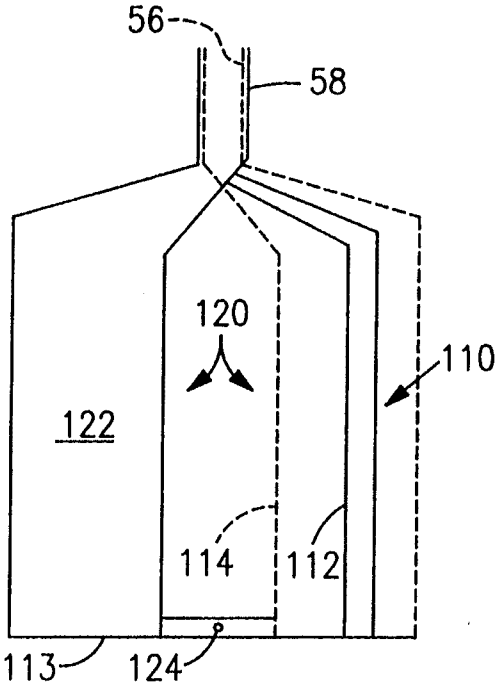
FIG. 8 illustrates another embodiment of the dipole antenna of FIG. 4.

FIG. 8 illustrates an alternate embodiment of the present invention in which an unbalanced quarter wavelength microstrip transmission line 110 substitutes for coaxial cable 60. Microstrip transmission line 110 comprises a quarter wavelength strip conductor 112 mounted or printed on one surface of a dielectric sheet 113 and a wider grounded strip conductor 114 mounted or printed on the other surface of the dielectric sheet. A balun 120 comprises another strip conductor 122 mounted or printed on the same side of the dielectric sheet 113 as the strip conductor 112 and also comprises the quarter length grounded strip conductor 114. A pin 124 connects the grounded strip conductor 114 to the strip conductor 122 to form the balun. The remainder of this embodiment of the invention is the same as in FIG. 4.

Figure 9:
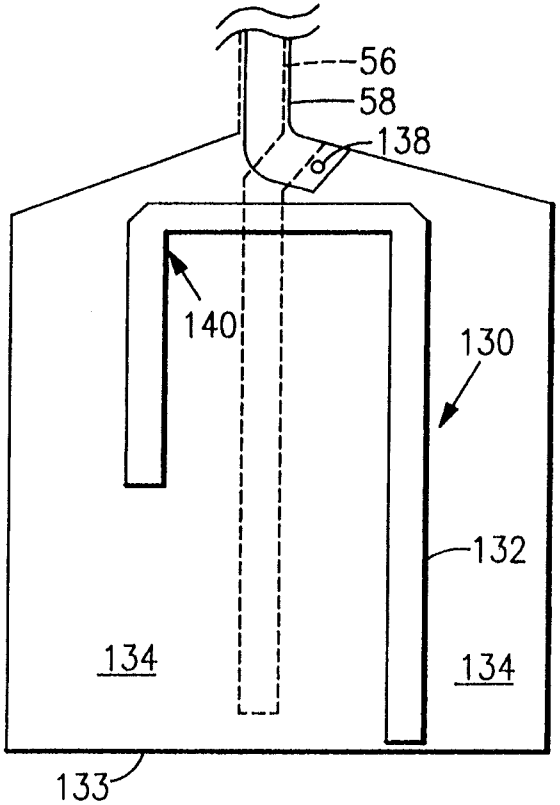
FIG. 9 illustrates still another embodiment of the dipole antenna of FIG. 4.

FIG. 9 illustrates another embodiment of the present invention in which an RF coupled transmission line 130 substitutes for coaxial cable 60. Transmission line 130 comprises a hook-shaped strip conductor 132 mounted or printed on one surface of a dielectric sheet 133 and a wider U-shaped, grounded strip conductor 134 mounted or printed on the other surface of the dielectric sheet. A quarter wavelength L-shaped top portion (or stub) 140 of the transmission line in conjunction with the grounded strip conductor 134 also forms a balun. Conductor 58 of the axial balanced transmission line is electrically connected to the grounded strip conductor 134 via a pin 138. The top portion of the transmission line 130 also radiates the drive signal to the balanced conductors 56 and 58. This type of transmission line is describe in prior art U.S. Pat. No. 4,825,220. The remainder of this embodiment of the present invention is the same as in FIG. 4.

Based on the foregoing, dipole antennas according to the present invention have been disclosed. However, numerous modifications and substitutions can be made without deviating from the scope of the present invention. For example, additional pairs of radiators can be stacked above radiator 52 to increase the gain and directivity. An axial extension of balanced conductors 56 and 58 supplies the drive signal to these additional pairs of radiators. Therefore, the invention has been disclosed by way of illustration and not limitation and reference should be made to the following claims to determine the scope of the present invention.

We claim:

1. A dipole antenna comprising:

a dielectric sheet;

first and second antenna radiators mounted to said sheet about a common axis without substantial longitudinal overlap;

a substantially balanced transmission line comprising first and second substantially balanced conductors printed on said sheet substantially along said axis, electrically connected to said first and second antenna radiators, respectively at facing ends of said antenna radiators and extending at least to an opposite end of one of said antenna radiators to receive an excitation signal for said antenna radiators; and a balun printed on said sheet and electrically connected to said transmission line approximately where said excitation signal is received.

2. An antenna as set forth in claim 1 wherein said balun is printed generally along said axis.

3. An antenna as set forth in claim 1 wherein said first antenna radiator comprises a first conductive tube mounted around and electrically connected to an edge of said sheet and said second antenna radiator comprises a second conductive tube mounted around and electrically connected to an edge of said sheet.

4. An antenna as set forth in claim 1 further comprising a second transmission line comprising third and fourth conductors electrically connected to said first and second balanced conductors, respectively, to supply said excitation signal for said antenna radiators.

5. An antenna as set forth in claim 4 wherein a portion of said second transmission line is mounted generally along said axis.

6. An antenna as set forth in claim 4 wherein said balun comprises a first conductive strip printed on one side of said sheet and a second conductive strip printed on the other side of said sheet.

7. An antenna as set forth in claim 6 wherein a quarter wavelength portion of said second transmission line is electrically connected along one of said conductive strips of said balun.

8. An antenna as set forth in claim 4 wherein said second transmission line comprises a coaxial cable having an inner conductor which forms said third conductor and an outer shield which forms said fourth conductor.

9. An antenna as set forth in claim 1 wherein:

said balun comprises a first conductive strip printed on one side of said sheet and a second conductive strip printed on the other side of said sheet.

10. An antenna as set forth in claim 1 wherein said first and second antenna radiators surround portions of said sheet.

11. An antenna as set forth in claim 10 wherein said first radiator comprises a first conductive strip printed on one side of said sheet and said second radiator comprises a second conductive strip printed on the other side of said sheet.

12. An antenna as set forth in claim 1 wherein said first balanced conductor is printed on one side of said sheet and said second balanced conductor is printed on the other side of said sheet.

13. An antenna as set forth in claim 1 wherein said antenna radiators are mounted adjacently, end to end and said first and second conductors mirror one another throughout an axial span of said one antenna radiator and throughout a gap between said antenna radiators.

14. A dipole antenna comprising:

a dielectric sheet;

first and second antenna radiators printed on said sheet about a common axis without substantial longitudinal overlap;

a substantially balanced transmission line comprising first and second substantially balanced conductors printed on said sheet substantially along said axis, electrically connected to said first and second antenna radiators, respectively at facing ends of said antenna radiators and extending at least to an opposite end of one of said antenna radiators to receive an excitation signal for said antenna radiators; and a balun printed on said sheet and electrically connected to said transmission line approximately where said excitation signal is received.

15. An antenna as set forth in claim 14 wherein each of said antenna radiators is generally U-shaped, and said balanced transmission line is printed along an axis of said U-shaped antenna radiators.

16. An antenna as set forth in claim 14 wherein said first radiator comprises a first U-shaped conductor portion printed on one side of said sheet and said second radiator comprises a second U-shaped conductor portion printed on the other side of said sheet, said facing ends being transverse portions of said U-shaped conductor portions.

17. An antenna as set forth in claim 16 wherein said transverse portions overhang one another on opposite sides of said sheet.

18. An antenna as set forth in claim 14 wherein:

said balun comprises a first conductive strip printed on one side of said sheet and a second conductive strip printed on the other side of said sheet.

19. An antenna as set forth in claim 14 further comprising a second transmission line comprising third and fourth conductors electrically connected to said first and second balanced conductors, respectively, to supply said excitation signal for said antenna radiators.

20. An antenna as set forth in claim 19 wherein said second transmission line comprises a coaxial cable having an inner conductor which forms said third conductor and an outer shield which forms said fourth conductor.

21. An antenna as set forth in claim 14 wherein said antenna radiators are mounted end to end and said first and second conductors mirror one another throughout an axial span of said one antenna radiator.

22. A dipole antenna comprising:

a dielectric sheet;

first and second antenna radiators mounted to and surrounding portions of said sheet about a common axis without substantial longitudinal overlap; and a transmission line comprising first and second conductors printed on said sheet, electrically connected to said first and second antenna radiators, respectively at facing ends of said antenna radiators and extending within one of said antenna radiators at least to an opposite end of said one antenna radiator to receive an excitation signal for said antenna radiators.

23. An antenna as set forth in claim 22 wherein said transmission line is printed substantially along said axis.

24. An antenna as set forth in claim 22 further comprising a balun printed on said sheet and electrically connected to said transmission line approximately where said excitation signal is received.

25. An antenna as set forth in claim 22 wherein said first and second conductors are substantially balanced.

26. An antenna as set forth in claim 22 wherein said first and second conductors are printed on opposite sides of said sheet and substantially mirror one another.

27. A dipole antenna comprising:

a dielectric sheet;

first and second antenna radiators printed on said sheet about a common axis without substantial longitudinal overlap, each of said radiators comprising two strip portions symmetrical about said axis; and a transmission line comprising first and second conductors printed on said sheet, electrically connected to said first and second antenna radiators, respectively at facing ends of said antenna radiators and extending between the strip portions of one of said antenna radiators to at least to an opposite end of said one antenna radiator to receive an excitation signal for said antenna radiators.

28. An antenna as set forth in claim 27 wherein said first and second conductors are printed on opposite sides of said sheet and are substantially balanced with each other.

29. An antenna as set forth in claim 27 further comprising a balun printed on said sheet and electrically connected to said transmission line approximately where said excitation signal is received.

* * * * *